US006651977B2

(12) United States Patent
Tanaka

(10) Patent No.: US 6,651,977 B2
(45) Date of Patent: Nov. 25, 2003

(54) PAPER FEEDING APPARATUS WITH STACK PRESENCE ACTUATOR

(75) Inventor: Hironori Tanaka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/963,468

(22) Filed: Sep. 27, 2001

(65) Prior Publication Data

US 2002/0036378 A1 Mar. 28, 2002

(30) Foreign Application Priority Data

Sep. 27, 2000 (JP) ..... P2000-295200

(51) Int. Cl.[7] ..... B65H 7/04
(52) U.S. Cl. ..... 271/154; 271/110; 271/265.01
(58) Field of Search ..... 271/153, 154, 271/265.01, 265.04, 110

(56) References Cited

U.S. PATENT DOCUMENTS

| | | | | |
|---|---|---|---|---|
| 4,449,705 A | | 5/1984 | Shibuya et al. | |
| 5,028,041 A | | 7/1991 | Kobayashi | |
| 5,552,859 A | * | 9/1996 | Nakagawa et al. | 271/110 |
| 5,732,307 A | * | 3/1998 | Yoshizuka et al. | 271/110 |
| 5,743,522 A | | 4/1998 | Rubscha et al. | |
| 5,944,430 A | * | 8/1999 | Myung | 271/153 |
| 6,247,695 B1 | * | 6/2001 | Linder et al. | 271/153 |

FOREIGN PATENT DOCUMENTS

| | | | |
|---|---|---|---|
| JP | 59064450 | | 4/1984 |
| JP | 61229755 | | 10/1986 |
| JP | 61-238633 A | | 10/1986 |
| JP | 61263552 | | 11/1986 |
| JP | 62285829 | | 12/1987 |
| JP | 63272736 | | 11/1988 |
| JP | 05058012 | | 3/1993 |
| JP | 9-67044 | * | 3/1997 |
| JP | 10087108 | | 4/1998 |
| JP | 11322131 | | 11/1999 |

* cited by examiner

*Primary Examiner*—Patrick Mackey
(74) *Attorney, Agent, or Firm*—Birch, Stewart, Kolasch & Birch, LLP

(57) ABSTRACT

A paper-feeding apparatus, which is not restricted by positions of sensors for detecting paper. Paper guides are provided which reliably reduces skew of the paper and enables precise printing by use of an uncomplicated structure. By providing the actuator with paper guide retracting fins, when the paper guide is moved in order to regulate the position of the paper, due to the slide between the paper guide retracting fins and the paper guide, the actuator is retracted out of the working area of the paper guide. With this structure, the actuator does not prevent the paper guide from being moved.

12 Claims, 5 Drawing Sheets

PAPER FEEDING APPARATUS WITH STACK PRESENCE ACTUATOR

BACKGROUND OF THE INVENTION

1. Field of the Invention

The present invention relates to a paper feeding apparatus which has a skew reducing function of recording paper or the original used in a printing or reading apparatus.

2. Description of the Related Art

In feeding the original to be read with sensors or in feeding recording paper to be printed, since the technique to reduce skew of paper is extremely important for carrying out precise printing, currently, a variety of techniques have been proposed.

For example, in Japanese Unexamined Patent Publications JP-A 59-64450 (1984) and JP-A 61-263552 (1986), a technique to prevent a jam from occurring is disclosed, in which skew of a fed paper is detected by means of optics.

In Japanese Unexamined Patent Publications JP-A 61-229755 (1986) and JP-A 62-285829 (1987), a technique to prevent skew of paper is disclosed in which the fed paper is made to come in contact with the shutter or a roller.

In Japanese Unexamined Patent Publication JP-A 10-87108 (1998), a technique to prevent skew by making the paper come in contact with a roller or the like is disclosed, in which a concrete setting method to feed paper successively is proposed.

In Japanese Unexamined Patent Publication JP-A 63-272736 (1988), a technique used in an both-sides reading apparatus is disclosed, in which a butting portion member is commonly used for reading one side of an original and for reading another side of the inversed original.

In Japanese Unexamined Patent Publication JP-A 5-58012 (1993), a technique is disclosed, in which a pair of two sensors disposed in the direction of transport direction of the paper are made to move in a direction orthogonal to the transport direction of the paper, and each output pattern is interpreted logically to determine transportation status of the paper.

In Japanese Unexamined Patent Publication JP-A 11-322131 (199), a technique to prevent skew from occurring is disclosed, in which a skew of a manually fed paper is detected, means for transporting paper not only in the forward feed direction but also in the backward direction is provided, a paper having a skew exceeding a predetermined amount is transported in the backward direction and discharged.

As described hereinbefore, it is a critical problem for carrying out a precise printing how to reduce skew of paper being fed, or what countermeasures should be taken after detecting a skew.

In these cases, the above-described countermeasures are too complex in structure or too expensive, and accordingly disadvantageous to a simple-structured paper feeding apparatus.

Herein, the simplest preventive method of skew is to provide paper guides as long as possible to the paper hopper on which paper is placed along the paper feed direction to regulate the position of the paper by means of the paper guide.

However, in order to detect of the status of the paper placed on the paper hopper, it is necessary to detect the paper by providing a paper sensor or a paper size sensor to the paper hopper.

Further, in case where too long paper guide is provided, since these sensors prevent the paper guide from moving when the guide is moved on the paper hopper, the length of the paper guide is restricted by the position of these sensors.

SUMMERY OF THE INVENTION

The invention was made to provide a paper feeding apparatus having a simple structure that reduces skew of paper reliably and enables a precise printing by virtue of paper feed guides that is not restricted by the position of the sensors.

The invention provides a paper feeding apparatus comprising a loading table having a loading plane on which paper is placed, a paper guide disposed to be movable in a second direction orthogonal to a first direction in which the paper is fed so as to come in contact with a side face of the paper at the second direction side to regulate a position of the paper, and a sensor provided with an actuator disposed to be movable in a direction of a normal to the loading plane, for detecting status of the paper on the loading table based on a position of the actuator in the direction of the normal to the loading plane, wherein the actuator is retracted in the direction separating away from the loading table along the direction of the normal to the loading table by a contact of the actuator with the paper guide movable in the second direction.

According to the invention, in the case where the paper guide is moved to regulate the paper, even when the actuator is disposed within the working area of the paper guide, since the actuator retracts out of the working area of the paper guide by virtue of an external force given by the paper guide, the actuator does not prevent the paper guide from being moved. By virtue of this, the length of the paper guide is not restricted by the position where the sensor is disposed. As a result, it is made possible to regulate the position of the paper more precisely as much as the length of the paper guide is made longer result in reliable prevention of skew on the paper by means of a simple structure.

In the invention it is preferable that the paper guide is movable in accordance with the size of the paper between the actuator separated away from the loading table and the loading table.

According to the invention, the paper guide is adapted to pass through the point where the actuator is disposed. Accordingly, since it is made possible to move the paper guide on the paper-loading table in accordance with the size of the paper to regulate the position of the paper, skew of the paper is reliably prevented.

In the invention it is preferable that the actuator has a shaft extending along an axis parallel to the normal to the loading plane and a sliding portion formed on one end of the shaft in a longitudinal direction close to the loading plane and extending in the second direction, for sliding on the paper guide, the sliding portion is formed so that a distance between the sliding face and the axis of the shaft is enlarged from the one end of the shaft in the longitudinal direction toward the another end in the longitudinal direction.

According to the invention, by virtue of the configuration of the actuator of which sliding portion is basically extending toward the another end of the shaft, when an external force is given by the paper guide, the external force acts on the actuator so that the actuator is lifted up in the direction separating away from the loading table along the normal to the loading table. Accordingly, it is made possible to make the actuator retract using the moving force of the paper guide.

The Same as the above, by means of movement of the paper that moves in the paper feed direction, the actuator moves to the upper face of the paper. Accordingly, it is made possible to detect the amount of the paper.

Therefore, since it is not necessary to provide a driving apparatus or the like for the aforementioned operation, it is made possible to give the paper feeding apparatus a simple structure.

In the invention it is preferable that the sliding section is disposed at both sides of the shaft in the second direction.

According to the invention, since the sliding section is disposed at both sides of the shaft of the actuator, even when the paper guide comes in contact with the actuator from either side in the second direction, the actuator is made to retract and the paper guide passes through under the retracted actuator. By virtue of this, it is made possible for the paper guide to pass through under the actuator in either direction.

Therefore, it is made possible to move the paper guide in accordance with the size of the paper to regulate the position of the paper.

In the invention it is preferable that the paper guide has a notch which is formed at a portion where the paper guide comes in contact with the actuator.

According to the invention, in the portion where the paper guide comes in contact with the actuator, since the notch is formed on the paper guide so as to be, comparing to the other portions, lower, it is made possible to make the distance of retraction of the actuator to be small. Whereas, since the other portions excluding the notch have enough height to regulate the position of the paper, the notch does not have any problem to regulate the position of the paper. Accordingly, it is made possible to regulate the position of the paper precisely.

In the invention it is preferable that the loading table is provided with a concave portion to which the actuator fits.

According to the invention, since the paper is detected at a position closer to the loading table as much as the actuator engages with a concave portion, it is made possible to make the paper detecting function to be executed without depending on the amount of the paper.

Therefore, the invention provides a paper-feeding apparatus that enables to reliably reduce skew on the paper resulting in a precise printing by means of a simple structure.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
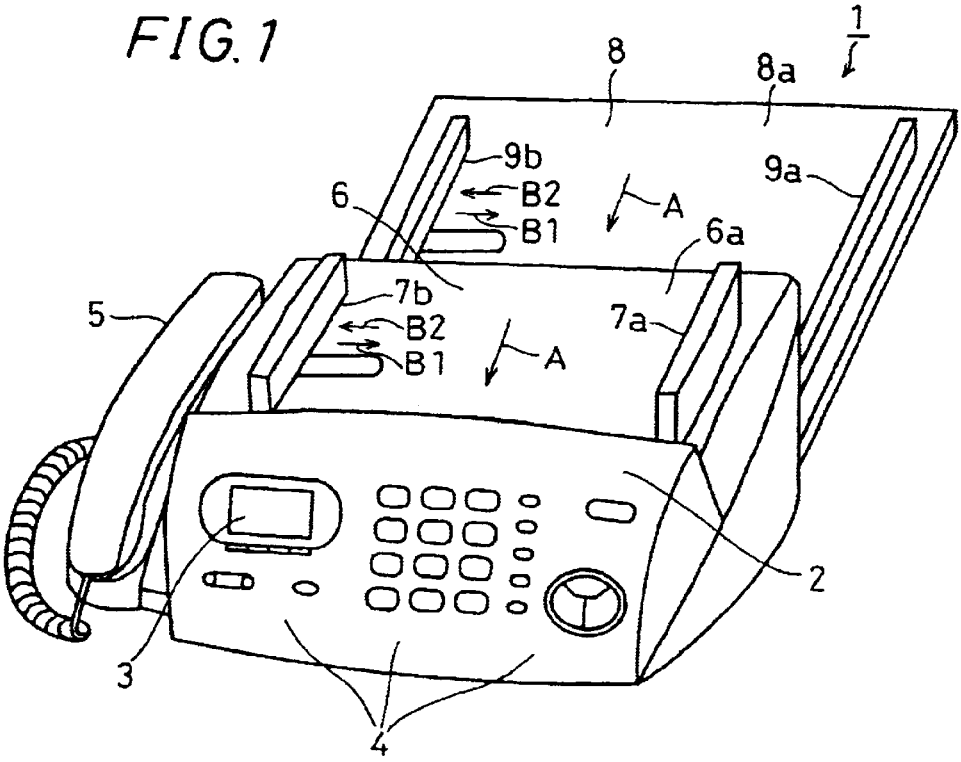
FIG. 1 is a perspective view of a facsimile machine to which a paper-feeding apparatus of the invention is applied.

Now referring to the drawings, preferred embodiments of the invention are described below.

Now referring to FIG. 1, a description will be made as to a structure of a facsimile machine to which the paper-feeding apparatus of the invention is applied.

FIG. 1 is a perspective view of a facsimile machine 1. Herein, in the mode of the embodiment, although the paper-feeding apparatus of the invention is applied to a facsimile machine, the relevant paper feeding apparatus may be applied to any paper feeding apparatus for feeding recording paper as well as original paper used in information processing apparatus and communication apparatus or the like.

In FIG. 1, provided on the upper portion of the front face of the facsimile machine 1 optimum to access thereto for the user is an operation panel 2 to which a man-machine interface function is integrated. Disposed on the operation panel 2 is a display 3 on which the facsimile machine 1 presents the user with information as well as necessary guidance and operation keys 4 with which the user inputs instructions and dial numbers into the facsimile machine 1.

The operation panel 2 is adapted to be opened and closed so as to allow the user to correct paper feed failure when an original or paper has jammed or a double feed or the like has occurred, or to clean the reading section easily.

A handset 5 is equipped with a transmitter and a receiver for communicating through the telephone to be used to communicate by means of voices using the facsimile machine 1.

Disposed behind the operation panel 2 is an original hopper 6 on which the original to be read for transmitting or duplicating is placed. The original hopper 6 is provided with a pair of original guides 7*a*, 7*b* for regulating the position of the original to prevent the original from skewing.

In the mode of the embodiment, one original guide 7*a* is disposed fixedly on the original hopper 6. Another original guide 7*b* is disposed so as to be movable in the guide slide directions B1, B2, which are second directions orthogonal to the paper feed direction A, which is a first direction in which the original is fed within the original loading plane 6*a* of the original hopper 6. Thus, regulation of the position of the original is made by sliding the another original guide 7*b* in the directions B1, B2 toward or away from the one original guide 7*a*; that is, in such a way, so-called one-side positioning. In place of this, the position of the original may be regulated by means of moving both original guides 7*a*, 7*b* toward or away from each other in the direction of guide slide directions B1, B2 with reference to the center of the width in the guide slide directions B1, B2 on the original hopper 6.

Further, the same as the aforementioned operation panel 2, the original hopper 6 is also adapted to be opened and closed so as to allow to correct paper feed failure when a recording paper fed from the portion below the original hopper has jammed due to a double-feed or a skew as well as to easily carry out maintenance service on the printing section such as ink replacement.

Whereas, disposed under the original hopper 6 is a recording paper hopper 8 for loading recording paper used to print out the received image and the read-out image. Herein, the recording paper hopper 8 is the loading table in the invention. The recording paper hopper 8 is provided with a pair of recording paper guides 9*a*, 9*b* for regulating the position of the recording paper to prevent the recording paper from skewing.

The one recording paper guide 9*a* is disposed fixedly on the recording paper hopper 8. The other recording paper guide 9*b* is disposed so as to be movable in the guide slide directions B1, B2, that intersect the paper feed direction A at right angles, which is a first direction in which the recording paper is fed within the recording paper loading plane 8*a* of the recording paper hopper 8. Still, the same as the original guides 7*a*, 7*b*, as for regulation of the position of the recording paper, as proposed in the mode of embodiment, it may be made by sliding the another recording paper guide 9*b* in the directions B1, B2 toward or away from the one recording paper guide 9*a*; that is, in such a way, so-called on-side positioning. Or, regulation of the position of the recording paper may be made by sliding the both recording paper guides 9*a*, 9*b* toward or away from each other in the direction of guide slide directions B1, B2 with reference to the center of the width in the guide slide directions B1, B2 on the recording paper hopper 8.

Figure 2:
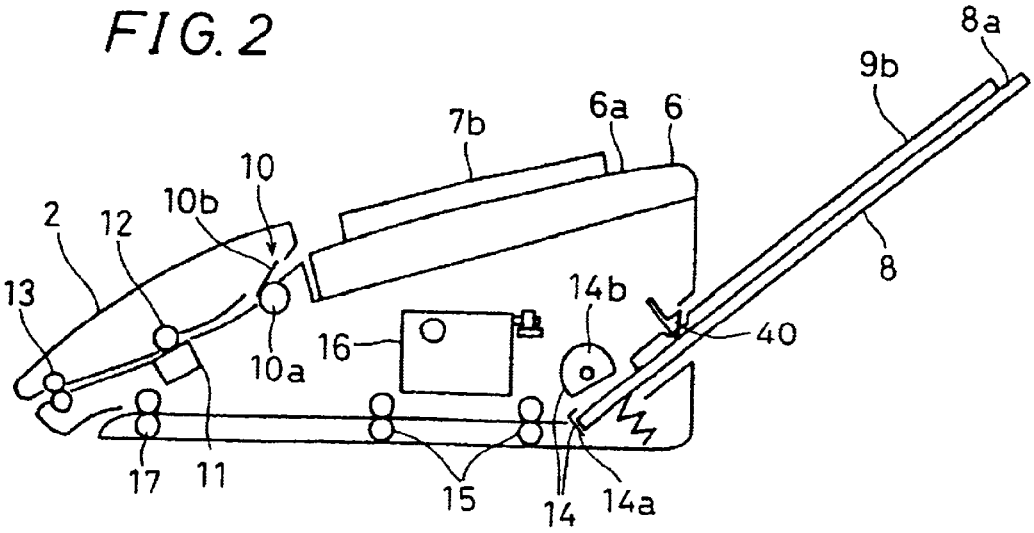
FIG. 2 is a sectional view of a facsimile machine to which a paper-feeding apparatus of the invention is applied.

Next, referring to FIG. 2, a description will be made as to an outline of the operation of the facsimile machine 1 to which the paper-feeding apparatus of the invention is applied.

First of all, the original to be read is placed on the original hopper 6 and regulated the position at both sides thereof by the respective original guides 7*a*, 7*b* to prevent the original from skewing. The loaded originals are separated one by one at an original separating section 10 comprised of a roller 10*a* and a stop rubber 10*b*, and each original goes through between a contact sensor 11 and a platen roller 12. At this time, the contact sensor 11 reads out the image, and the original after being read is discharged to the outside of the machine by the original discharge roller 13.

Whereas, recording paper are loaded on the recording paper hopper 8. The recording paper is regulated the position at both sides thereof by the recording paper guides 9*a*, 9*b*. Although recording paper is placed on the hopper, in order to detect the size of the recording paper, a plurality of sensors are provided on the recording paper hopper 8. Each recording paper loaded on the recording paper hopper 8 is separated one by one by a recording paper separating section 14 comprised of a separator catch 14*a* for holding the recording paper at both sides thereof and a semilunar roller 14*b*, and is transported by a paper feed roller 15. Printing is made on the transported paper by a printing section 16 and is discharged outside of the machine from the recording paper discharge roller 17.

Hereinafter, referring to FIG. 3, a description will be made as to the structure of an actuator provided to the sensor for detecting the status of the paper, which is provided to the paper-feeding apparatus of the invention.

Figure 3:
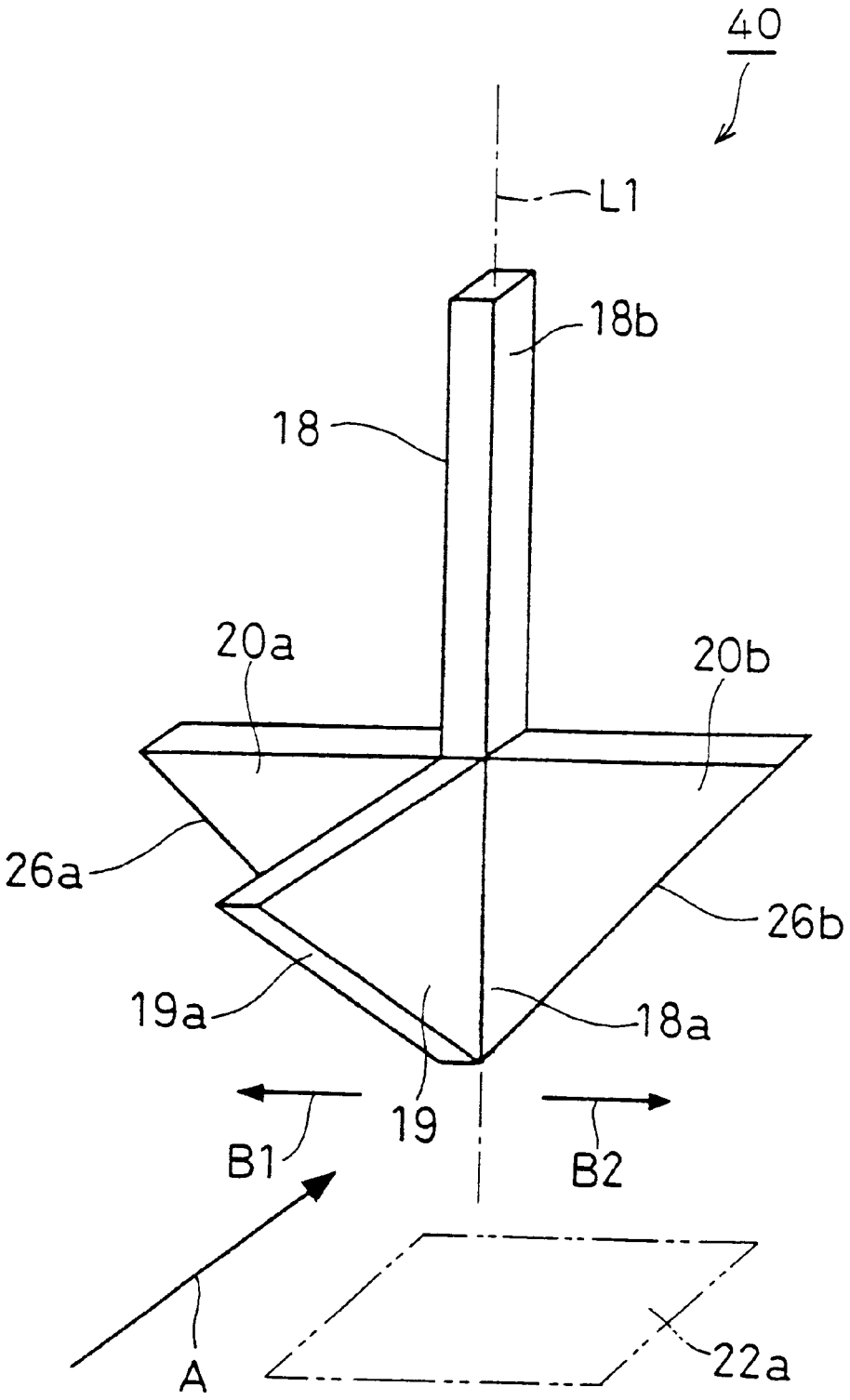
FIG. 3 is a perspective view of an actuator of the invention.

FIG. 3 is a perspective view of an actuator 40 provided to the aforementioned paper sensor. The arrow A indicates the paper feed direction; whereas, the arrows B1, B2 indicate the moving directions of the guide. Herein, the word "paper sensor" means commonly both of the original sensor for detecting the status of an original and the recording paper sensor for detecting the recording paper, and the basic structure thereof is identical without depending on the case for the original or the recording paper. Therefore, in the following descriptions, a paper hopper 22 shown in FIG. 3, FIG. 4, FIG. 5A, FIG. 5B and FIG. 6A to FIG. 6D, means commonly both of the original hopper 6 and the recording paper hopper 8; and the paper guide 21 means commonly both of the original guide 7*b* and the recording paper guide 9*b*. Still further, a loading plane 22*a* means commonly the original loading plane 6*a* and the recording paper loading plane 8*a*. And paper 24 means commonly both of the original and the recording paper.

The actuator has a shaft 18 and, around the same, three fins 19, 20*a*, 20*b* are formed at the one end 18*a* of the shaft 18 adjacent to the loading plane 22*a* in the longitudinal direction. In the three fins, the fin disposed along to the paper feed direction is a paper detection fin 19; whereas, two fins disposed symmetrically extending toward the opposite directions from the shaft 18 in the directions of guide slide directions B1, B2 are paper guide retracting fins 20*a*, 20*b* that are the sliding portions.

Herein, the paper detection fin 19 is used for detecting paper, whereas the paper guide retracting fins 20*a*, 20*b* are used for retracting the actuator 40 when the paper guide goes through between the actuator and the loading table. In the mode of the embodiment, the respective fins 19, 20*a*, 20*b* are formed so that the distance between the respective sliding faces 19*a*, 26*a*, 26*b* and axis L1 of the shaft 18 is enlarged in the direction from the end 18*a* of the shaft 18 in the longitudinal direction toward the another end 18*b* of the shaft 18 in the longitudinal direction accordingly. As a concrete example, in the mode of the embodiment, the respective fins 19, 20*a*, 20*b* have a taper respectively. As for the configuration of the fins, it is not limited to the configuration of the mode of the embodiment; it may be round-shaped or oval-shaped. That is to say, when the fin 19 and the paper 24 or the fins 20*a*, 20*b* and the paper guide 21 make sliding contact with each other, any configuration of the fins may be acceptable provided that it facilitates retraction of the actuator 40 by moving the fins 19, 20*a*, 20*b* in the direction separating away from the paper hopper along the normal of the loading plane 22*a* on the paper hopper 22 by an external force given by the paper 24 or the paper guide 21.

The actuator 40 is disposed so as to be movable in the direction toward or away from the paper hopper along the slop line on the paper hopper 22 smoothly. When the paper is detected or the paper guide is retracted, the actuator 40 moves in the direction separating away from the loading table. At this time, the shaft 18 of the actuator 40 is the portion that is inserted into the inside of the facsimile machine 1.

Figure 4:
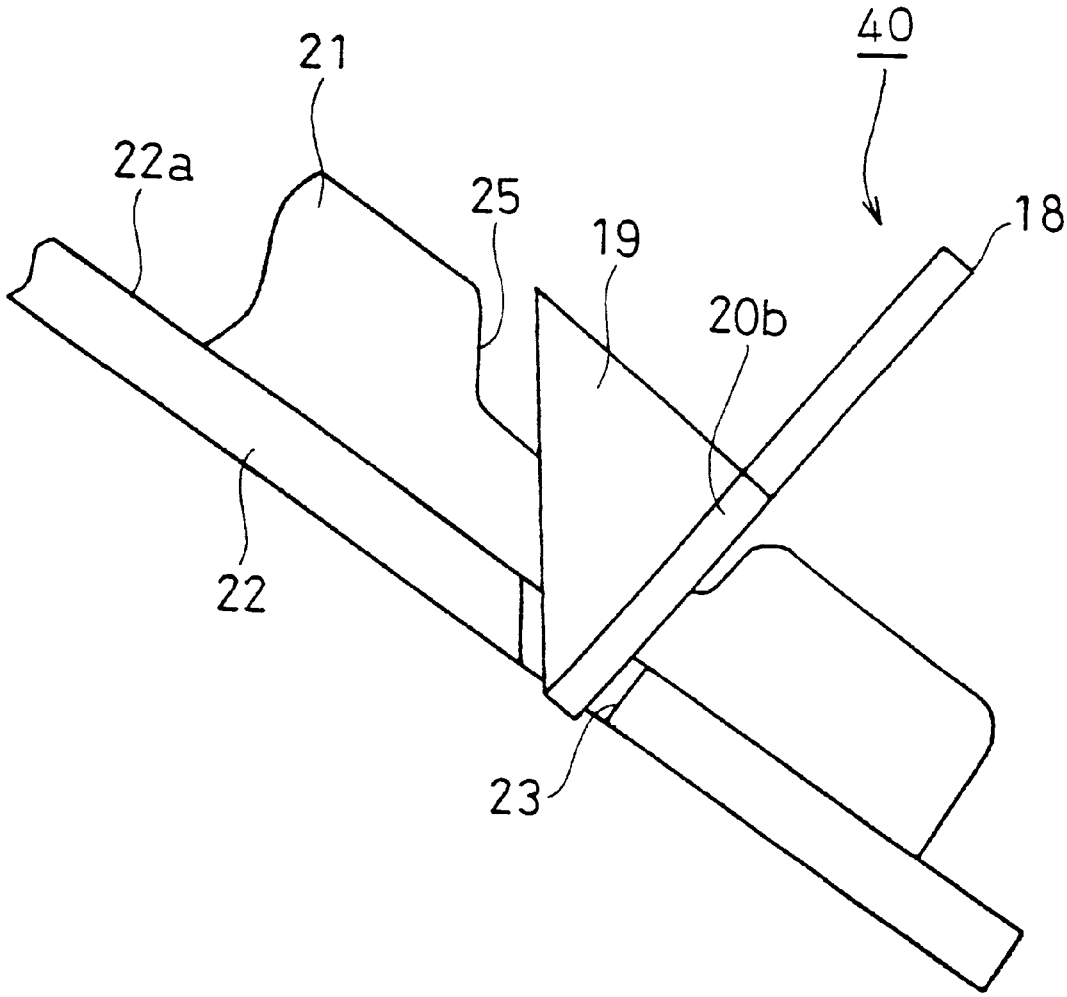
FIG. 4 is a diagram illustrating a relationship between the paper guide and the actuator of the invention.

FIG. 4 is a diagram illustrating a relationship between the actuator 40 and the paper guide 21.

As shown in FIG. 4, the paper hopper 22 as a paper loading table is formed with a paper hopper notch 23 at a portion where it comes in contact with the actuator 40. Herein, the hopper notch 23 is the concave portion of the invention. Since it is made possible for the actuator 40 to be positioned closer to the paper hopper 22 as much as the actuator 40 is inserted into the paper hopper notch 23, it is made possible to make the stroke of the paper sensor be longer as well as to detect the paper correctly even when, for example, only a sheet of paper is remaining on the paper hopper 22.

Figure 5A:
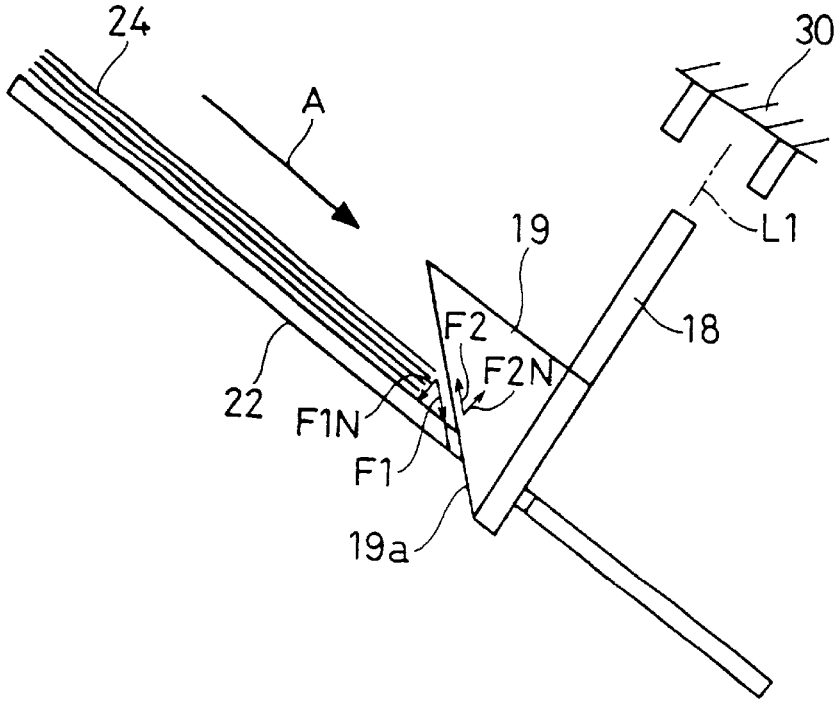
FIG. 5A and FIG. 5B are diagrams illustrating the action of the actuator of the invention caused by paper.
Figure 5B:
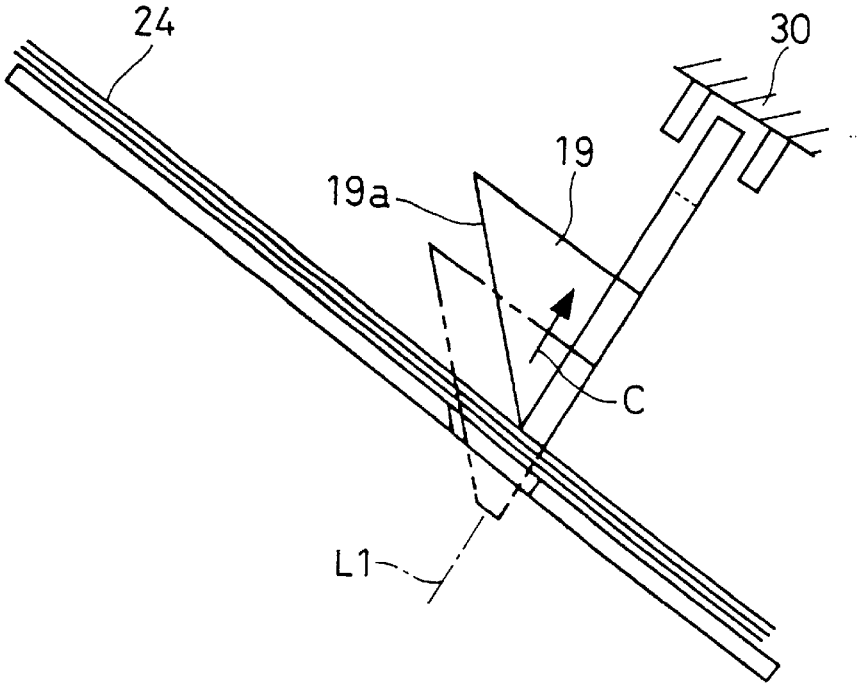

Herein, referring to FIG. 5A and FIG. 5B, a description will be made as to the action of the actuator 40. FIG. 5A and FIG. 5B are diagrams illustrating the paper hopper 22 viewed from the side thereof. To simplify the diagram, the paper guide 21 is omitted.

As shown in FIG. 5A, the paper 24 is fed in the direction of the arrow A. After the paper 24 has come in contact with the actuator 40, as the paper 24 moves in the paper feed direction, shearing forces F1, F2 are generated in the opposite directions to each other along the sliding face 19*a* of the paper detection fin 19 at the portion where the paper 24 and the paper detection fin 19 come in contact with each other.

Due to the shearing force F1, a component F1N that is parallel to the direction of the normal of the paper loading plane 22*a* acts on the paper 24 as a force to make the paper 24 closer to the paper hopper 22. Whereas, due to the shearing force F2, a component F2N which is opposite direction to the component F1N acts as a force that make the paper detection fin 19 separate away from the paper hopper 22.

Due to the action of the shearing forces F1, F2, the paper detection fin 19 moves to the upper face of the paper 24 by sliding between the front end of the paper 24 and the sliding face 19*a*. The status of this is shown in FIG. 5B.

As described hereinbefore, the actuator 40 moves along the axis L1 of the shaft 18 and is adapted to be engaged with and disengaged from the facsimile machine 1. Herein, due to the slide between the sliding face 19*a* of the paper detection fin 19 and the front end of the paper 24, the shaft 18 moves in the direction separating away from the paper hopper 22 along the normal to the paper loading plane 22*a*. At this time, the shaft 18 allows the beam from a photosensor 30 provided to the facsimile machine 1 to pass through or cut it off. Thus, based on the status of the beam, the photosensor 30 detects the shaft 18. As a result, it is detected whether paper resides or not.

The same as the paper detection fin 19, the paper guide retracting fins 20*a*, 20*b* also have the sloped sliding faces 26*a*, 26*b* respectively.

Now referring to FIG. 6A to FIG. 6D, a description will be made as to the action in which the actuator 40 is retracted out of the working area of the paper guide 21 by means of the movement thereof. A paper guide notch 25 as shown in the figures to be referred hereinafter is formed at a point where the same comes in contact with the guide retracting fins 20*a* 20*b*. The height of the paper guide 21 at the notch 25 is formed to be lower than the other portions of the paper guide 21. By forming the paper guide notch 25 as described above, it is made possible to carry out the following actions described below easily.

Figure 6A:
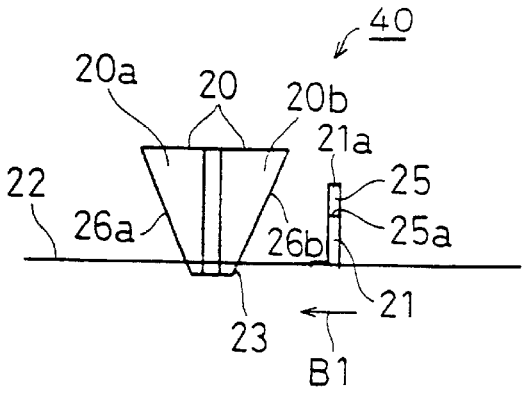
FIG. 6A to FIG. 6D are diagrams illustrating action of the actuator of the invention caused by the paper guide.

FIG. 6A illustrates a status in which the lower portion of the actuator 40 is inserted into a paper hopper notch 23 and is resting therein.

Figure 6B:
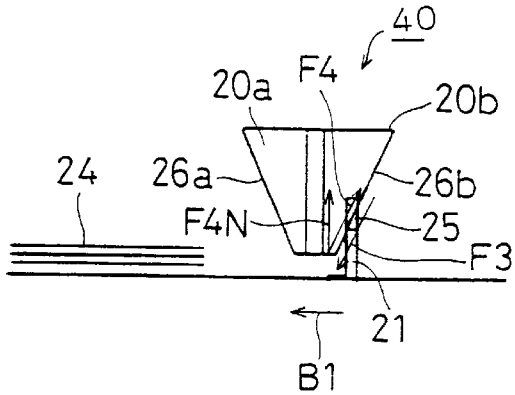

FIG. 6B illustrates a status in which the paper guide 21 has come in contact with the paper guide retracting fin 20, in case where the paper 24 is loaded and in order to regulate the position of the paper 24 in accordance with the size of the paper, the paper guide 21 is moved in the direction of the guide slide direction B1 to make the paper guide to be closer to the paper 24.

At this time, when a force is given to the sliding face 26*b* of the paper guide retracting fin 20*b* by the paper guide 21, shearing forces F3, F4 are generated to the paper guide retracting fin 20*b* and the paper guide 21 respectively in the opposite directions to each other at a portion where the paper guide retracting fin 20*b* and the paper guide 21 come in contact with each. Particularly, due to the component F4N of the shearing force F4 in the direction of the normal of the paper loading plane 22*a*, the paper guide-retracting fin 20 is lifted up away from the paper hopper 22. As a result, the actuator 40 is made to retract in the direction separating away from the paper hopper 22.

Figure 6C:
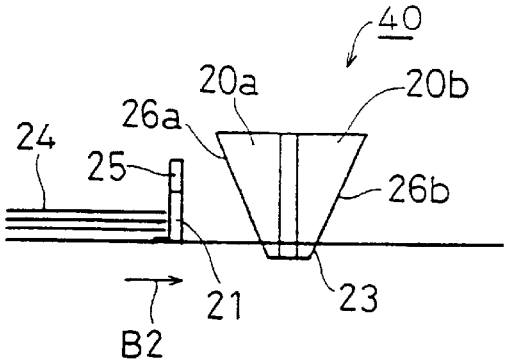

When the paper guide retracting fin 20 is lifted up a certain amount, a space enough to allow the paper guide 21 to pass through is made between the actuator 40 and the paper hopper 22. The paper guide 21 passes through the space made under the actuator 40 and comes in contact with the side face of the loaded paper 24 and regulates the position of the paper 24. The status of this is shown in FIG. 6*c*.

Figure 6D:
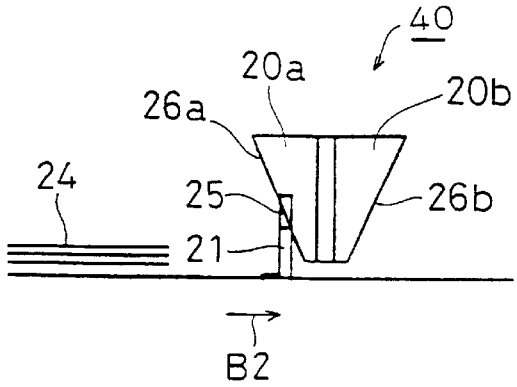

Herein, as shown in FIG. 6D, in order to replace the paper 24 with a larger one to be placed on the paper hopper 22, when the paper guide 21 is moved in the direction B2 separating away from the paper, the same as the case described above, by giving a force to the sliding face 26*a* on the guide retracing fin 20*a* and retract the actuator 40 by means of the paper guide 21 in the direction separating away from the paper hopper 22 to allow the paper guide 21 to pass through under the actuator 40, it is made possible to regulate larger paper.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper feeding apparatus comprising:

a loading table having a loading plane on which paper is placed, a paper guide disposed to be movable in a second direction orthogonal to a first direction in which the paper is fed so as to come in contact with a side face of the paper at the second direction side to regulate a position of the paper, a sensor provided with an actuator disposed to be movable in a direction normal to the loading plane, for detecting status of the paper on the loading table based on a position of the actuator in the direction of the normal to the loading plane, and the paper guide has a notch which is formed at a portion where the paper guide comes in contact with the actuator, wherein the actuator is retracted in the direction separating away from the loading table along the direction of the normal to the loading table by a contact of the actuator with the paper guide movable in the second direction.

2. The paper feeding apparatus of claim 1, wherein the paper guide is movable in accordance with the size of the paper between the actuator separated away from the loading table and the loading table.

3. The paper feeding apparatus of claim 1, wherein the actuator has a shaft extending along an axis parallel to the normal to the loading plane and a sliding portion formed on one end of the shaft in a longitudinal direction close to the loading plane and extending in the second direction, for sliding on the paper guide, the sliding portion is formed so that a distance between the sliding face and the axis of the shaft is enlarged from the one end of the shaft in the longitudinal direction toward the another end in the longitudinal direction.

4. The paper feeding apparatus of claim 2, wherein the actuator has a shaft extending along an axis parallel to the normal to the loading plane and a sliding portion formed on one end of the shaft in a longitudinal direction close to the loading plane and extending in the second direction, for sliding on the paper guide, the sliding portion is formed so that a distance between the sliding face and the axis of the shaft is enlarged from the one end of the shaft in the longitudinal direction toward the another end in the longitudinal direction.

5. The paper feeding apparatus of claim 3, wherein the sliding section is disposed at both sides of the shaft in the second direction.

6. The paper feeding apparatus of claim 4, wherein the sliding section is disposed at both sides of the shaft in the second direction.

7. The paper feeding apparatus of claim 1, wherein the loading table is provided with a concave portion to which the actuator fits.

8. The paper feeding apparatus of claim 1, wherein the actuator has a shaft with at least one fin formed at an end of the shaft.

9. The paper feeding apparatus of claim 8, wherein the fin is adjacent to the loading plane.

10. The paper feeding apparatus of claim 8, wherein there are three fins.

11. The paper feeding apparatus of claim 10, wherein the fins are adjacent to the loading plane.

12. The paper feeding apparatus of claim 1, wherein there is a second movable paper guide located in the same longitudinal direction as the paper guide.

* * * * *